US006544335B2

(12) United States Patent
Gambini

(10) Patent No.: US 6,544,335 B2
(45) Date of Patent: Apr. 8, 2003

(54) DEVICE FOR DISTRIBUTING GLUE ON AN END EDGE OF A LOG, A LOG OR A CORE FOR A LOG

(76) Inventor: Giovanni Gambini, Via A. Omodeo 7, I-56124 Pisa (IT)

( * ) Notice: Subject to any disclaimer, the term of this patent is extended or adjusted under 35 U.S.C. 154(b) by 69 days.

(21) Appl. No.: 09/900,405

(22) Filed: Jul. 6, 2001

(65) Prior Publication Data

US 2002/0005164 A1 Jan. 17, 2002

(30) Foreign Application Priority Data

Jul. 11, 2000 (IT) ..... MI2000A001559

(51) Int. Cl.[7] ..... B05C 1/02
(52) U.S. Cl. ..... 118/257; 156/578
(58) Field of Search ..... 118/106, 257; 427/207.1; 156/578, 446

(56) References Cited

U.S. PATENT DOCUMENTS 5,681,421 A * 10/1997 Biagiotti ..... 156/446

* cited by examiner

*Primary Examiner*—Laura Edwards
(74) *Attorney, Agent, or Firm*—Hedman & Costigan, P.C.

(57) ABSTRACT

A device for distributing glue on an end edge of a log, a log or a core for a log, comprising a feeder (26) of logs (19, 19') or cores (25) towards a glue dispensing unit, in which the glue dispensing unit comprises a tank (15) containing glue (20) in which is placed a thread (12) wound in a loop on at least two end pulleys (13), at least one of which is commanded in continuous rotation by a gear motor (14), the thread (12) having a lower branch which lifts the glue and an upper branch which releases the glue on an end edge (18, 18') of a log (19, 19'), a log (19, 19') or a core (25) for a log.

8 Claims, 4 Drawing Sheets

DEVICE FOR DISTRIBUTING GLUE ON AN END EDGE OF A LOG, A LOG OR A CORE FOR A LOG

The present invention relates to a device for distributing glue on an end edge of a log, a log or a core for a log.

In the field of preparing rolls of toilet paper, or paper for use in the home and similar, called "logs", the current practice is to distribute or position glue in various ways both on the end edge of the individual log formed and beforehand on the internal core of the log, if present.

The glue is used in the first case to make the final edge integral with the remaining part of the roll, in the second case to allow the initial edge of the roll that is to be formed to be firmly anchored to the core.

This application of glue is carried out either using spray glue dispensers or passing the end edge or the core over a slit where the glue is dispensed by means of a weir.

While these devices of the prior art work well, they do not allow the glue to be distributed very easily.

Furthermore, in the first case, as the glue is distributed by dispensers, it is not always continuous and straight and a build-up of glue may be formed even in undesired parts of the paper or it may dirty the machine. The dispensers are also delicate and must be checked and regulated so as not to use excessive amounts of glue.

Furthermore, in the second case, due to the fact that the glue comes out through a weir, over which either the end edge of the roll or the core passes, the whole machine may get dirty or even the inside of the roll.

The object of the present invention is therefore to find a different solution for the above mentioned technical problem.

A further object is to realise a device which always guarantees complete distribution of glue along the entire transverse dimension of the end edge of the log, of a log or of the internal core.

Yet another object is to realise a device which is able to perform the above mentioned task and which is particularly easy to operate and easy to clean.

These objects are achieved according to the present invention, realising a device for distributing glue on an end edge of a log, a log or a core for a log as explained in claim 1, enclosed.

Further important characteristics of the present invention are dealt with in the dependent claims.

Figure 1:
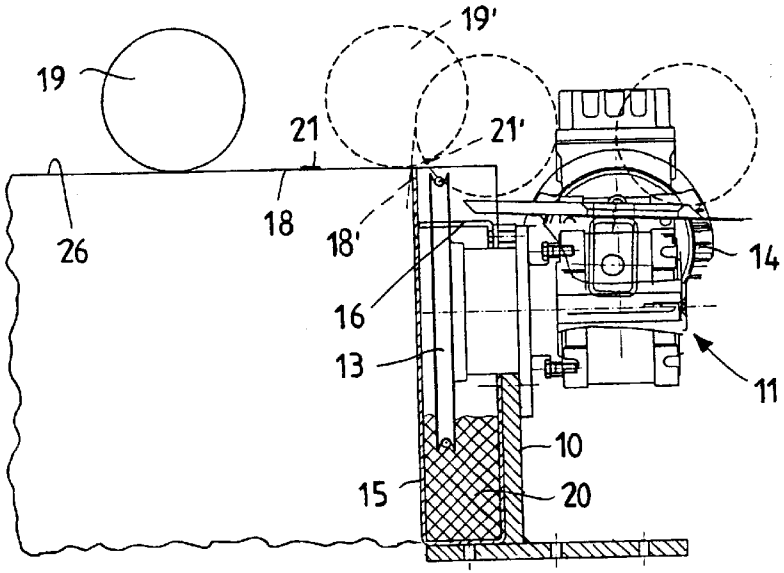
Figure 3:
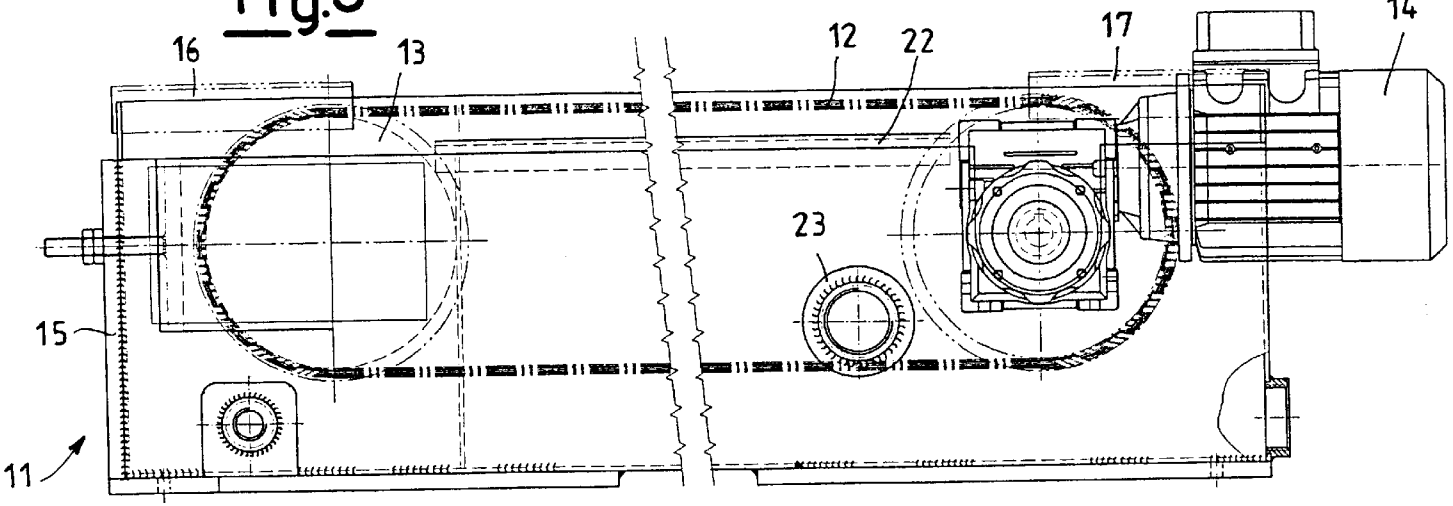
Figure 2:
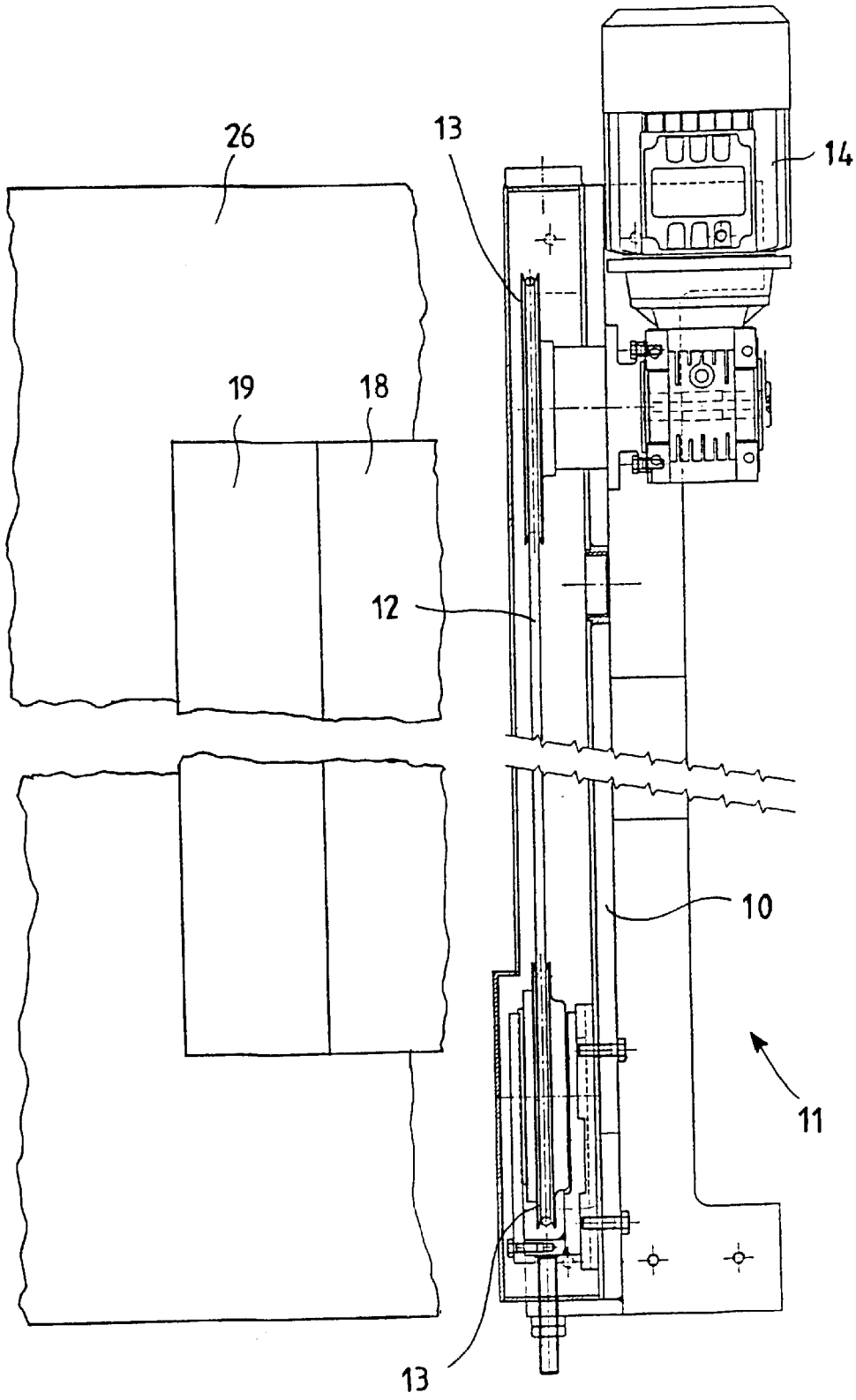
Figure 4:
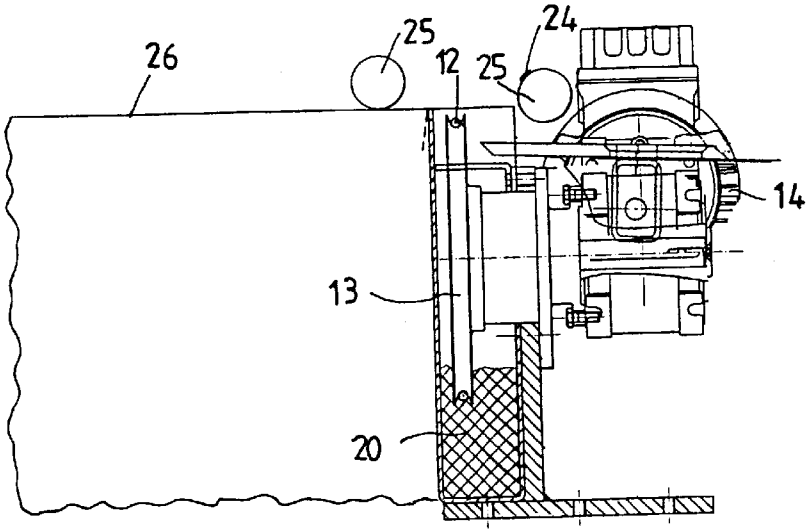
Figure 6:
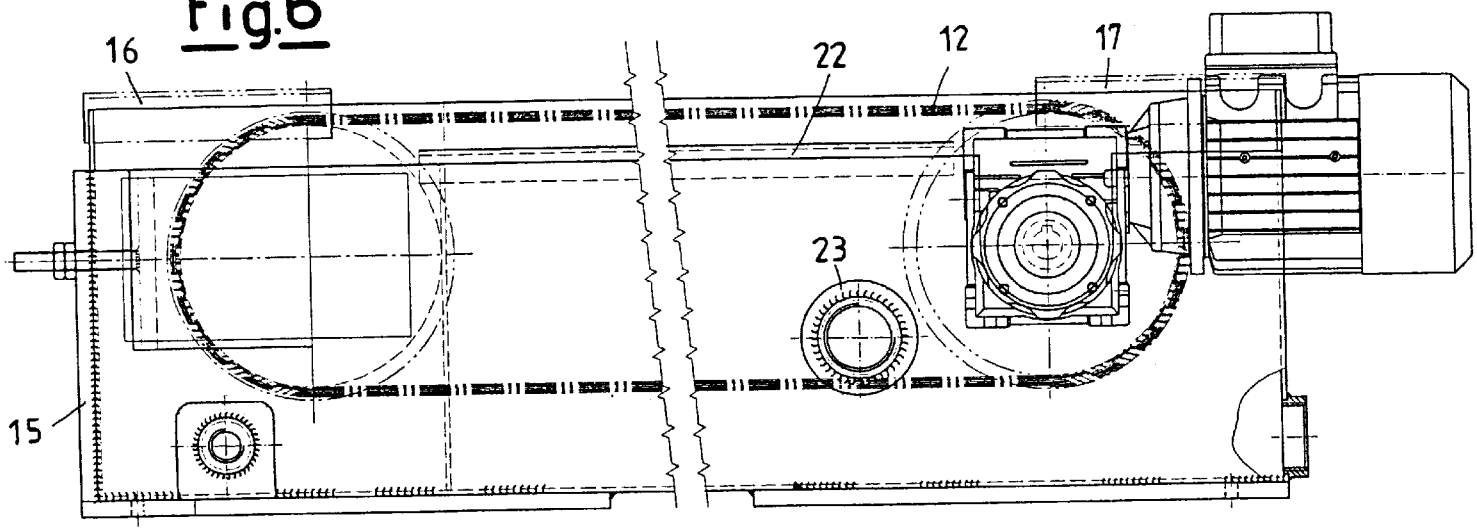
Figure 5:
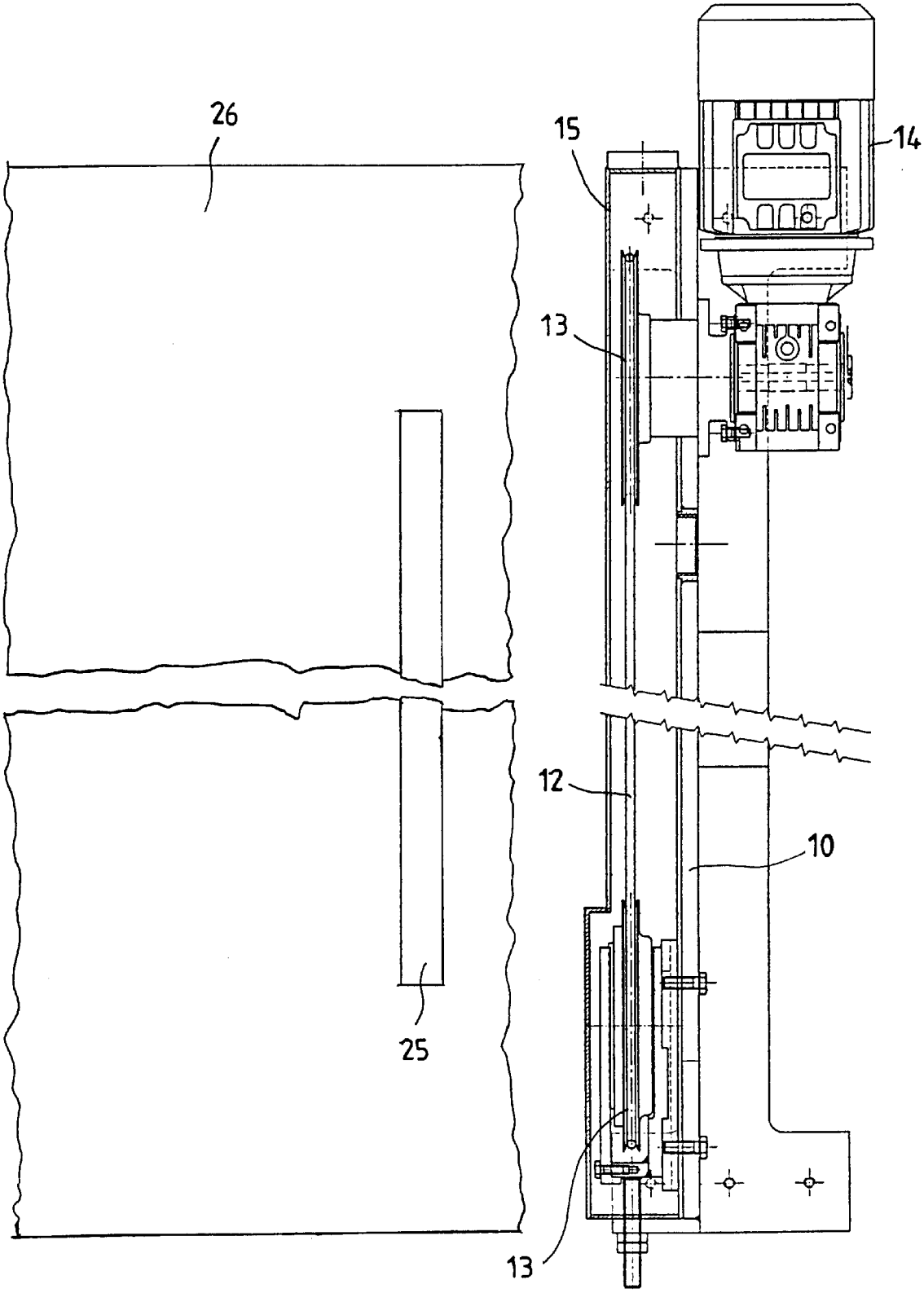

The characteristics and the advantages of a device for distributing glue on an end edge of a log, a log or a core for a log according to the present invention will be more clearly seen from the following description, supplied purely as an example without limitation, of an embodiment with reference to the enclosed figures in which:

FIG. 1 is a partial section of a device according to the present invention with the glue deposited on the end edge of the paper of the log or on a log which is laid on or arrives from a feeding surface, FIG. 2 is a top plan view of the device in FIG. 1, FIG. 3 is a cross section of the device in FIG. 1, FIG. 4 is a partial section of a device according to the present invention in which it is shown how the device may also be applied to a core to be inserted inside a log, FIG. 5 is a top plan view of the device in FIG. 4, FIG. 6 is a cross section of the device in FIG. 4.

With reference first to FIGS. 1–3, a device for distributing glue is shown, indicated overall with 11, on an end edge 18 of a log 19 which may be placed inside any type of machine for log production, as defined previously.

The device 11 comprises very simply, downstream from a feeding surface 26, a glue dispensing unit as specified below. The dispensing unit comprises a thread 12 which is laid in a transverse direction to the direction of movement of the paper being wound to create the roll. The thread 12 in the example is of the loop type, wound on end pulleys 13, two in the example, at least one of which is commanded in continuous rotation by a gear motor 14. The pulleys 13 are supported in rotation on walls 10 of a tank 15.

The thread 12 is also passed through the tank 15 in which is placed special glue 20 suitable for the use specified above and, turning along its path over the pulleys 13, it lifts and drags the glue 20, depositing it on the paper. The thread thus has a lower branch which lifts the glue and an upper branch which releases the glue on the paper or on the roll. For example the tank 15 may be closed like a box and have special closing casings 16 and 17 on its upper ends to leave towards the outside a free length of thread 12 which has received and transports the glue 20 before going back, turning on the pulleys, into the box 15 to lift the glue 20 again which is now deposited on the paper in the form of a strip 21.

The two closing casings 16 and 17, together with a central casing 22, form the output and input opening for the length of thread 12 which generally allows the glue to be deposited on the paper.

In FIG. 1 the solid line shows the application of a strip 21 of glue 20 on the end edge 18 place at the front of the log 19 on the feeding surface 26. The roll or log 19 is made "skip" over the thread so that the end edge 18 receives inside it a strip 21 of glue 20. This end edge 18 then rewinds on the roll 19 and is anchored to it thanks to the presence of the glue.

Furthermore the dashed and dotted line shows the possible passage of a roll 19' on the thread 12 with an end edge 18' of the roll 19' which follows the roll itself or log. In this second possible situation a strip of glue 21' is laid on the roll or log 19' and the end edge 18' goes onto the glue and in that position it is firmly anchored to the strip 21'.

Furthermore FIG. 3 shows how a stretching roller 23 can be provided which collaborates in the firm positioning of the thread 12, facilitating the operation of the whole device.

FIG. 2 represents only the first case mentioned above in which the end edge 18 is situated at the front of the log or roll 19.

The FIGS. 4–6 show how the thread 12, forming part of the glue dispensing unit shown above, can also be used to release a strip 24 of glue 20 on a core 25 which is provided, when requested, inside the log to be formed.

The core 25 is generally fed to a log formation area by means of a special core loader, for example sliding on a feeding surface 26, and before being provided with glue and sent into the area where the paper unrolled from a reel (not shown) is received.

Passing over the thread 12 of the same type as those previously illustrated, the core 25 receives the strip 24 of glue 20. Only at this point does feeding occur of an initial edge (not shown) of the paper which is thus anchored to the core 25 and starts to be wound onto the core following the correct arrangement.

Obviously the same considerations may be made of a core 25 which may be fed according to a direction aligned with and parallel to the thread 12, or with the core 25 which is passed above or below the thread 12. In this case the castings 16 and 17 must be adapted to allow convenient passage of the core 25.

It has thus been seen that a device for distributing glue on an end edge of a log or a core for a log according to the present invention achieves the objectives stated previously.

Numerous modifications and variations may be made to the device as conceived in the present invention, all falling within the scope of the invention itself. Moreover, in practice the materials used, their dimensions and their components, may be any ones that suit the technical requirements.

What is claimed is:

1. Device for distributing glue on an end edge of a log, a log or a core for a log comprising a feeder (26) of logs (19, 19') or cores (25) towards a glue dispensing unit, characterised in that said glue dispensing unit comprises a tank (15) containing glue (20) in which is placed a thread (12) wound in a loop on at least two end pulleys (13), at least one of which is commanded in continuous rotation by a gear motor (14), said thread (12) having a lower branch which lifts said glue and an upper branch which releases said glue on an end edge (18, 18') of a log (19, 19'), a log (19, 19') or a core (25) for a log.

2. Device according to claim 1, characterised in that said thread (12) is laid in a transverse direction to the direction of movement of said end edge (18, 18') of a log (19, 19'), said log (19, 19') or said core (25) for a log.

3. Device according to claim 1, characterised in that said thread (12) is laid parallel to the direction of movement of said core (25) for a log.

4. Device according to claim 1, characterised in that said pulleys (13) are supported in rotation on walls (10) of said tank (15).

5. Device according to claim 1, characterised in that there is provided at least one stretching roller (23) which regulates said thread (12).

6. Device according to claim 1, characterised in that said tank (15) is closed like a box and has output and input openings for said thread (12).

7. Device according to claim 1, characterised in that said tank (15) has at its opposite upper ends closing casings (16, 17) to leave towards the outside a free length of thread (12) which has received and transports said glue (20) before going back, turning on said pulleys (13), into said tank (15).

8. Device according to claim 7, characterised in that a central casing (22) is further provided which, together with said two closing casings (16, 17), forms the output and input openings for said thread (12).

* * * * *